US007172511B2

(12) United States Patent
Casey

(10) Patent No.: US 7,172,511 B2
(45) Date of Patent: Feb. 6, 2007

(54) AMUSEMENT RIDE

(76) Inventor: Thomas P. Casey, 8622 Shoss Ave., St. Louis, MO (US) 63125

( * ) Notice: Subject to any disclaimer, the term of this patent is extended or adjusted under 35 U.S.C. 154(b) by 0 days.

(21) Appl. No.: 11/028,163

(22) Filed: Jan. 3, 2005

(65) Prior Publication Data

US 2006/0144282 A1 Jul. 6, 2006

(51) Int. Cl.
*A63G 1/00* (2006.01)

(52) U.S. Cl. ..... 472/47; 104/53

(58) Field of Classification Search ..... 104/53, 104/56, 57, 63, 64, 65, 66; 472/47, 60, 59
See application file for complete search history.

(56) References Cited

U.S. PATENT DOCUMENTS

| | | | | |
|---|---|---|---|---|
| 1,065,642 | A | 6/1913 | Traver | |
| 1,911,915 | A | 5/1933 | McLaughlin | |
| 1,935,558 | A | 11/1933 | Haskell | |
| 2,249,076 | A | 7/1941 | Courtney | |
| 2,437,000 | A | 3/1948 | McBride | |
| 2,800,328 | A | 7/1957 | Courtney | |
| 2,864,614 | A | 12/1958 | Castille | |
| 2,907,568 | A | 10/1959 | Velare et al. | |
| 3,176,983 | A | 4/1965 | Barber | |
| 3,596,905 | A | 8/1971 | Brown | 272/29 |
| 3,952,826 | A | 4/1976 | Barker et al. | 180/136 |
| 4,162,582 | A * | 7/1979 | McGraw et al. | 434/44 |
| 4,193,308 | A | 3/1980 | Stuhler et al. | 74/5.22 |
| 4,216,963 | A | 8/1980 | Boucher | 273/110 |
| 4,445,495 | A | 5/1984 | Frost | 126/24 |
| 4,512,192 | A | 4/1985 | Peters | 73/505 |
| 4,721,274 | A | 1/1988 | Erb | 248/179 |
| 4,824,099 | A * | 4/1989 | Rusu et al. | 472/3 |
| 5,046,721 | A * | 9/1991 | Altare | 482/17 |
| 5,188,566 | A | 2/1993 | Bohme | 472/45 |
| 5,490,784 | A * | 2/1996 | Carmein | 434/55 |
| 5,759,107 | A * | 6/1998 | Nagel | 472/47 |
| 5,791,998 | A * | 8/1998 | Moser et al. | 472/31 |
| 5,964,665 | A | 10/1999 | Uemura | 472/45 |
| 6,402,624 | B1 | 6/2002 | Larson et al. | 472/44 |
| 6,601,468 | B2 | 8/2003 | Grover et al. | 74/490.03 |

* cited by examiner

*Primary Examiner*—S. Joseph Morano
*Assistant Examiner*—Robert J. McCarry, Jr.
(74) *Attorney, Agent, or Firm*—Haverstock, Garrett & Roberts LLP

(57) ABSTRACT

A gimbaled wheel amusement ride is disclosed.

11 Claims, 15 Drawing Sheets

AMUSEMENT RIDE

BACKGROUND OF THE INVENTION

1. Technical Field

This invention relates to amusement rides.

2. Background of the Prior Art

Various types of amusement rides are known including, for example, rotating wheels, or Ferris wheels, revolving columns, etc. and all having a number of cars. The cars may be rotated regularly or irregularly to achieve an exciting movement varying in speed and direction. Other known types of rides exploit centrifugal force to maintain passengers in a given position in opposition to the force of gravity. However, people are always seeking new amusement thrills, and therefore there is a constant need to improve and design new amusement rides which will satisfy this need.

SUMMARY OF THE INVENTION

Referring to FIGS. 1 and 2, the amusement ride of the present invention comprises at least two gimbaled wheels or closed loop tracks, capable of rotating and revolving to uniquely provide a path of travel to its riders which entails, on at least one wheel, traveling about at least three axes i.e. X, Y, and Z, and on at least two wheels traveling about at least two axes. X is a first transverse axis. Y is a second transverse axis which moves within X and is perpendicular to X. Z is a moving radial axis which varies its orientation as each wheel turns. Although the invention has been illustrated and claimed having vertically disposed super structures supporting horizontal drive shafts or mechanisms and establishing horizontal static shafts for establishing horizontal transverse axes of travel, the super structures could readily be disposed horizontally, supporting vertical drive shafts and vertical static shafts for establishing vertical, rather than horizontal transverse axes of travel.

The gimbaled motion of the present invention involves two wheels 10 and 20 moving in revolutions per minute (rpm) at a 1:1:1 ratio vis-à-vis axes X:Y:Z. As shown in FIGS. 3–10, there are successive scenes illustrating the path of travel when viewing directly down a first transverse axis X. FIGS. 3*a*–10*a* are the same scenes, but from views directly down the second transverse axis Y. As the first or outer wheel 10 revolves transversely about axis X it follows path X', and the second or inner wheel 20 will, by necessity, also revolve transversely, in tandem with outer wheel 10, along X', but inner wheel 20, unlike outer wheel 10, also revolves transversely about axis Y along path Y'.

Outer wheel 10 and inner wheel 20 may begin operation as in FIG. 3, where paths $Z'_{10}$ and $Z'_{20}$ are concentrically aligned as a single path $Z'_{10/20}$. Outer wheel 10, because it supports inner wheel 20, serves to constantly change the angle or pitch of axis Y and axis $Z_{10}$ and $Z_{20}$.

Note that point P progresses in its rotation $Z'_{10}$ from, for example, its point at FIG. 3, to its point at FIG. 4 and onto its point at FIG. 5. Although there is no imaginary point P on inner wheel 20, it also operates to rotate along its independent path $Z'_{20}$ as better seen along axis Y, i.e. FIGS. 4*a* and 5*a*.

The rpm ratio for X':Y':Z' may vary from 1:1:1 to as high as 1:1:12 or higher and the ratio of X' to Y' may vary also.

Referring now to FIGS. 11–14, the actual path of travel of a passenger car as for Example $P'_{10}$ (on the outer wheel) and $P'_{20}$ (on the inner wheel) of the amusement ride may vary infinitely in its geometry, depending upon the rpm ratios with respect to the various rotations and revolutions, so long as the passenger cars are substantially equidistant from true center T of the ride.

As will be better understood from the Detailed Description, the ratio of rotation for $Z'_{10}$ to $Z'_{20}$ will depend upon how those axial rotations are linked or coupled. The path of travel of a car on the outer wheel 10, i.e. $P'_{10,}$ and that of a car on the inner wheel 20, i.e. $P'_{20}$can appear as illustrated in FIGS. 11 and 12 when there is a $X':Y':Z'_{10}:Z'_{20}$ of 1:1:1:1. This is distinguished from the path of travel of $P'_{10}$ when the ratio of speeds of $Z'_{10}$:X' is for example about 12:1 and where X':Y' is 1:1, as may more likely resemble FIGS. 13 and 14.

BRIEF DESCRIPTION OF THE DRAWINGS

FIGS. 3*a*–10*a* are same sequence as FIGS. 3–10 above, but as viewed directly down axis Y.

DETAILED DESCRIPTION AND PREFERRED EMBODIMENTS

Figure 1:
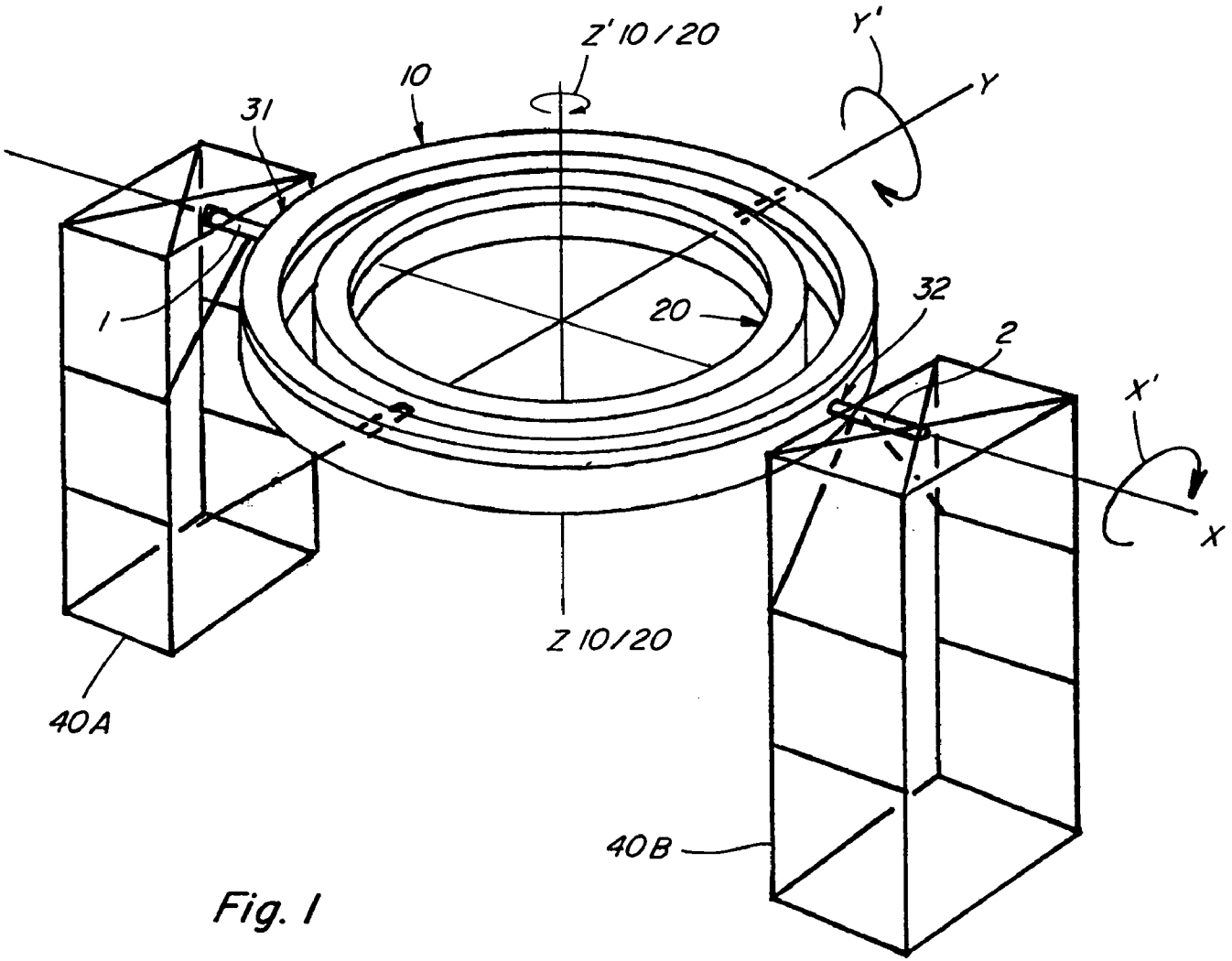
FIG. 1 is a perspective view of the amusement ride of the present invention.
Figure 15:
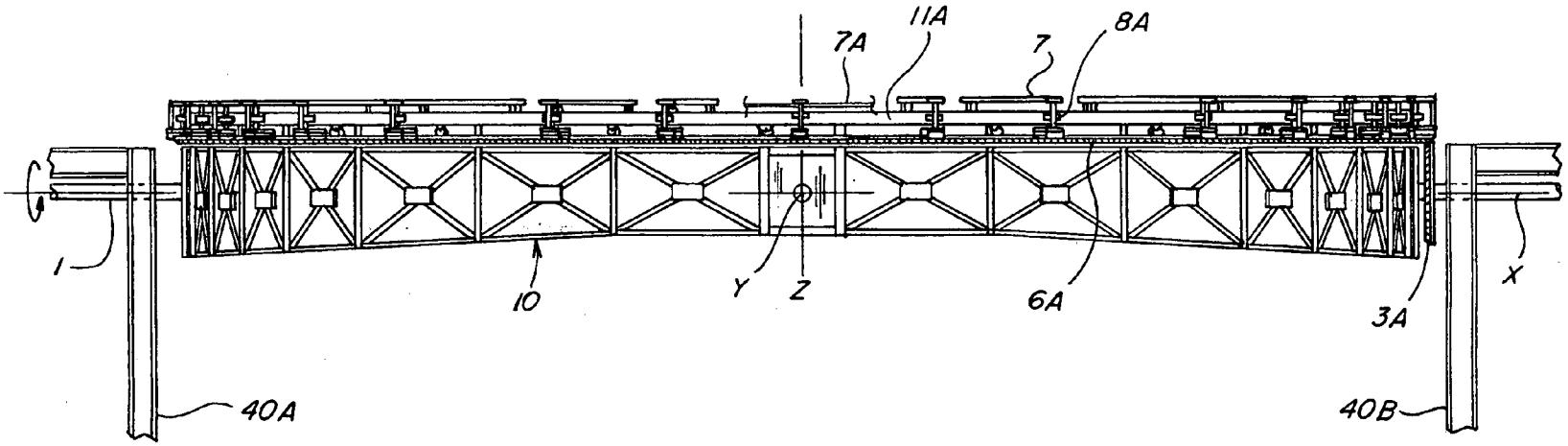
FIG. 15 is a front view of the amusement ride as seen along line 15—15 in FIG. 2.

Generally, the apparatus of this invention as shown in FIG. 1 comprises an outer wheel 10, having gimbaled therein at least one inner wheel 20. Outer wheel 10 preferably is supported by framework 30 at each of two outer wheel sections 31 and 32 via shafts 1 and 2, respectively. Wheels 10, 20 and potential additional internal wheel 300 (shown on FIG. 2) may be constructed using any of various suitable designs. The wheels may resemble solid rims or have hollow construction or as preferred may embody the construction in FIG. 15 with crisscrossed reinforcements, i.e. a super structure similar to bridge supports or Ferris wheels.

Figure 16:
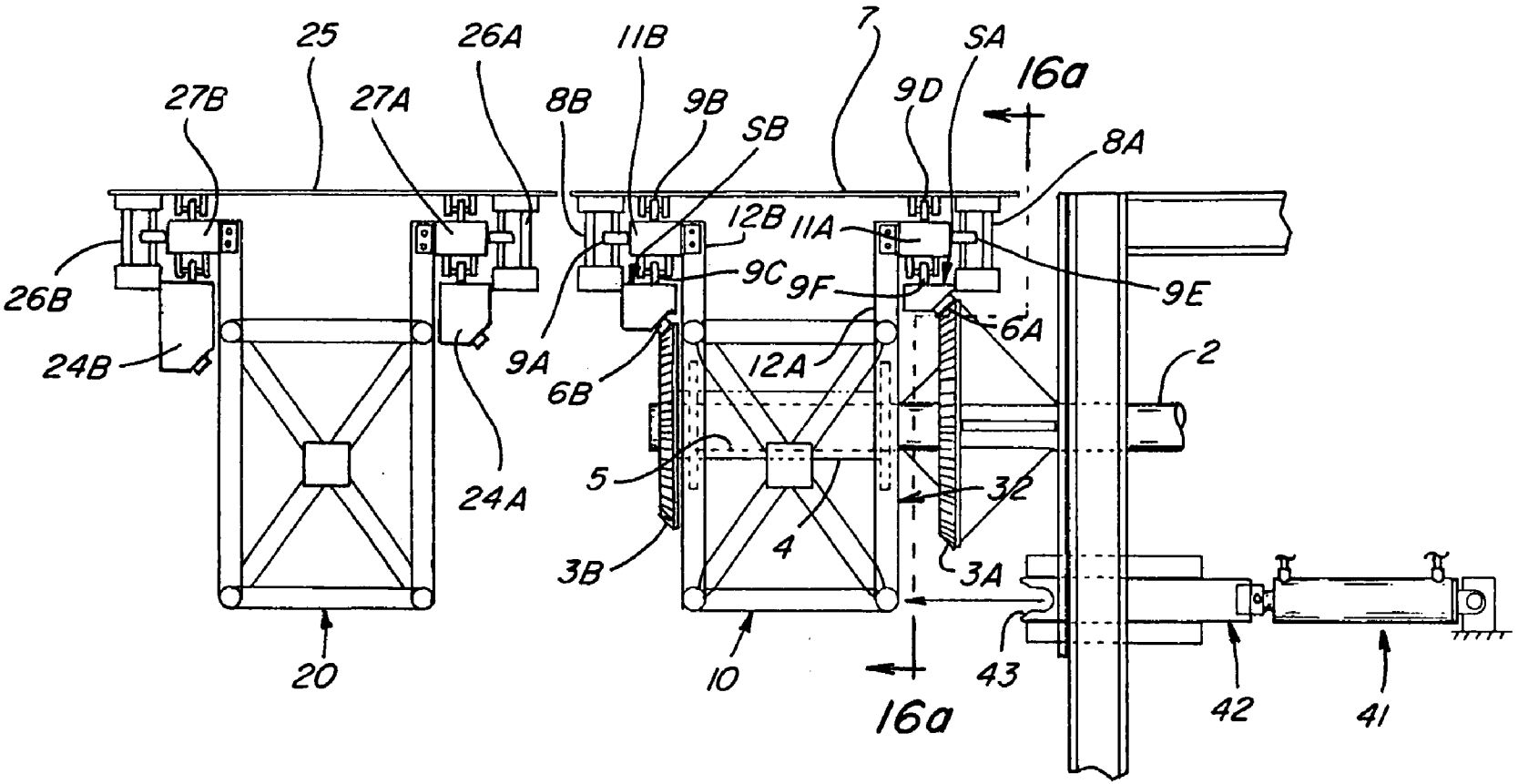
FIG. 16 is a partial cross-sectional view along line 16—16 in FIG. 2.

Refer now to FIGS. 2, 4*a*, 15, 16, 17, 19, and 22. Drive shaft 1 extends horizontally from power source 100, at its one end, while being fixed at its opposite end to outer wheel 10, at drive section 31. Static gear shaft 2 is affixed onto support structure 40B. Static gear shaft 2 extends horizontally between vertically disposed static gears 3A and 3B, while resting revolvably in bushing 4, in opening 5, of the outer wheel 10's first static section 32. Thus, outer wheel 10 can support at least one passenger car 200 (FIG. 22) while power source 100 (FIG. 2) drives shaft 1, which in turn causes outer wheel 10 to revolve transversely, about axis X, along a path X'. The static shaft 2, being located 180° from the drive shaft 1, is disposed to also assist outer wheel 10 to revolve about axis X. Static gears 3A and 3B engage outer ring gears 6A and 6B (FIGS. 16 and 17) which outer ring gears are disposed to rotatably envelope (see FIG. 15) substantially the entire periphery of the outer wheel 10. The ring gears 6A and 6B are affixed to a carriage member 7 by a plurality of support members such as 8A and 8B (which can be designed as a single extensive support if desired), so as to slide via roller members 9A, 9B, 9C, 9D, 9E, and 9F, about the periphery of outer wheel 10, in tandem with the rotation of the ring gears 6A and 6B, while the ring gears walk engagingly around the periphery of vertically disposed static gears 3A and 3B. This allows the outer ring gears 6A and 6B to rotate axially around axis $Z_{10}$ in the path designated as $Z'_{10}$, (FIG. 4*a*) as outer wheel 10 revolves transversely about axis X. Note that certain rollers slide along tracks 11A and 11B (FIGS. 15, 16, and 16*a*) which are integrally fixed to the outer wheel 10 frame work 12*a* and 12*b* (FIG. 16). This embodiment of the invention at FIG. 16 shows rollers 9C and 9F are integrally attached to the tracks 11B and 11A respectively, and therefore roll along top surfaces SB and SA of the outer ring gears 6B and 6A respectively, which surfaces are opposite of the teeth of the ring gears 6B and 6A. The other rollers 9A, 9B, 9D and 9E are actually integrally attached to the carriage 7 or the carriage supports 8A or 8B. However, this roller system can be designed to accommodate other suitable embodiments if desired. Other alternatives to rollers, for enabling the carriage 7 to slide along the tracks 11A and 11B may be employed if desired.

Referring particularly to FIGS. 18, 19, 20 and 21, the gimbaled relationship between outer wheel 10 and inner wheel 20 is illustrated and the invention's preferred embodiments are further set forth. There is a transfer shaft 13 extending through bushing 14 in opening 15 of outer wheel 10 and fixedly connected to vertically disposed transfer gears 16A and 16B at one end, while fixedly connected to inner wheel 20 at its opposite end. The section 33 of outer wheel 10, through which inner wheel transfer shaft 13 extends into opening 15, is referred to as outer wheel transfer section 33, while the section 34 of inner wheel 20, where transfer shaft 13 is affixed, is referred to as inner wheel transfer section 34. Transfer shaft 13 therefore, when disposed horizontally, serves to establish a second transverse horizontal axis, i.e. Y. Accordingly, as the tandem axial rotation of carriage 7 and outer ring gears 6A and 6B proceeds about axis $Z'_{10}$ the outer ring gears 6A and 6B engage vertically disposed transfer gears 16A and 16B respectively which, in turn, causes transfer shaft 13 to revolve, and causes a transfer of power to inner wheel 20 which revolves transversely about axis Y. The transfer point 33 on outer wheel 10 is 90° from the static point 32 of outer wheel 10.

Figure 5:
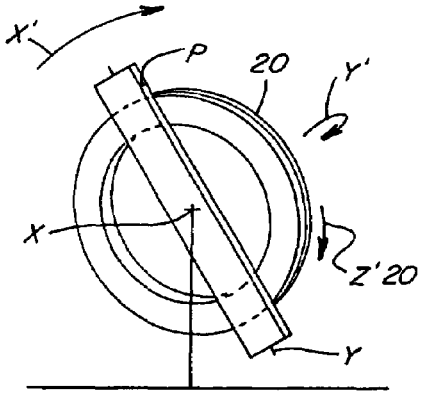
Figure 5A:
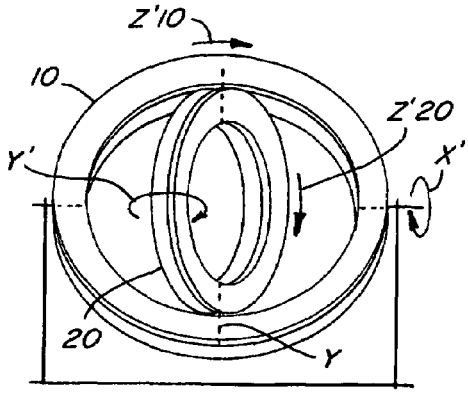
Figure 6:
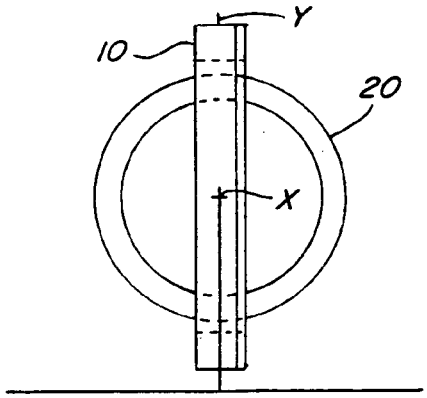
Figure 6A:
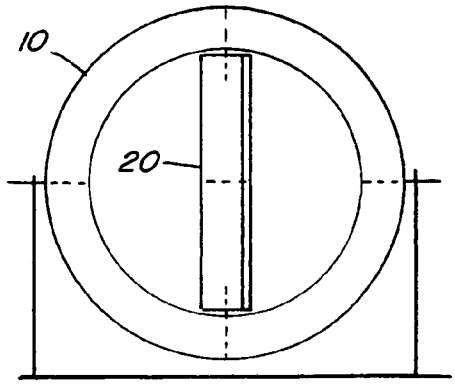
Figure 7:
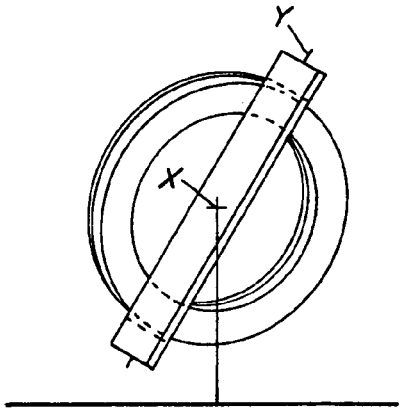
Figure 7A:
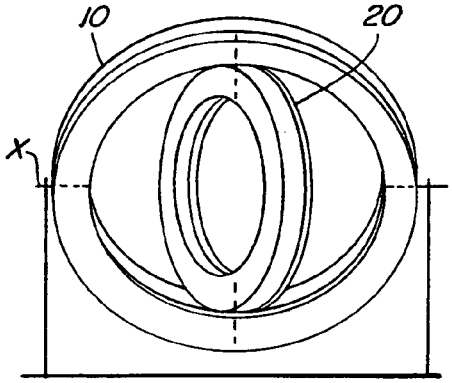
Figure 8:
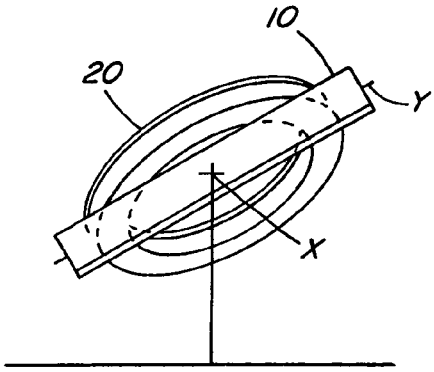
Figure 8A:
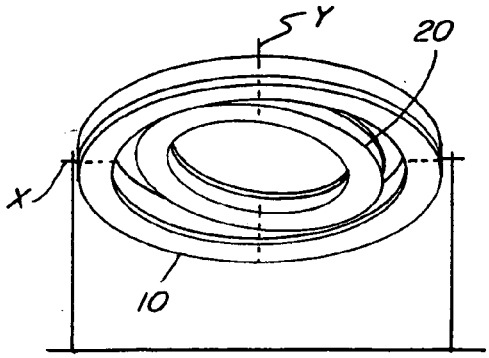
Figure 9:
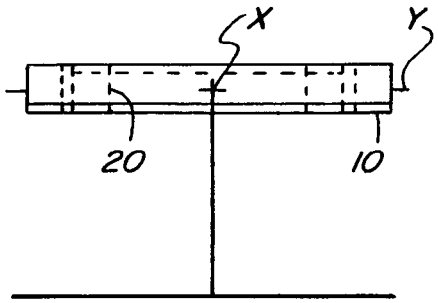
Figure 9A:
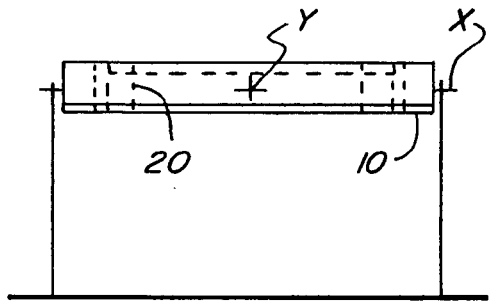
Figure 10:
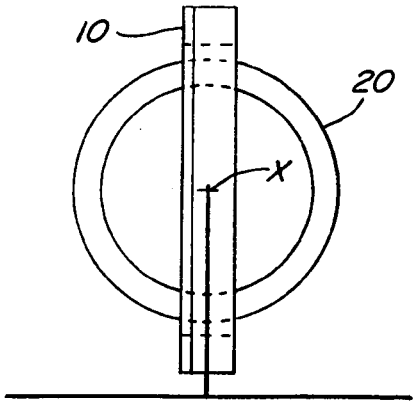
Figure 10A:
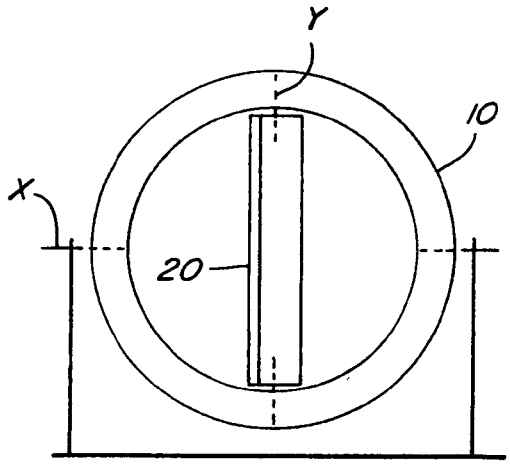
Figure 11:
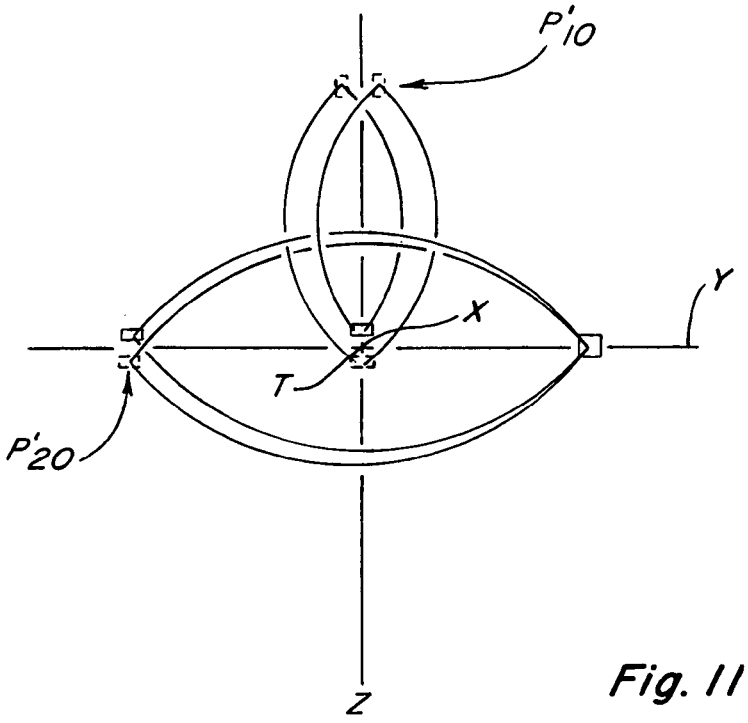
FIG. 11 is a view of the path of travel of a passenger car or module $P'_{10}$ on the outer wheel and passenger car $P'_{20}$ on the inner wheel if viewed directly down axis X, at an rpm ratio of 1:1 of the outer wheel car $P'_{10}$ to the inner wheel car $P'_{20}$, including rpms being equal for $Z'_{10}$, $Z'_{20}$, X'; and Y'.
Figure 12:
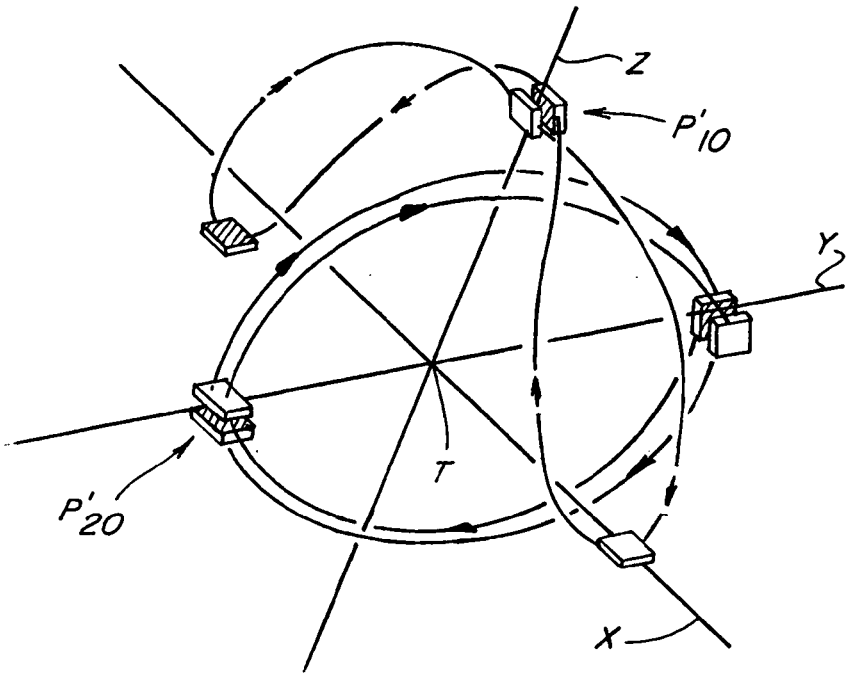
FIG. 12 is a perspective view of the paths shown in FIG. 11.
Figure 13:
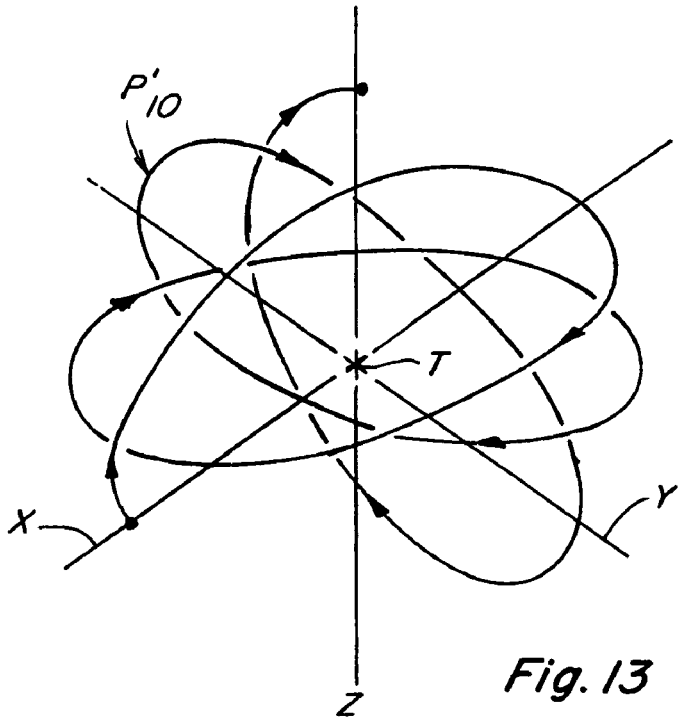
FIG. 13 is a perspective of the paths of travel of $P'_{10}$ and $P'_{20}$ when the rpm ratio of Z':X':Y'=12:1:1.
Figure 14:
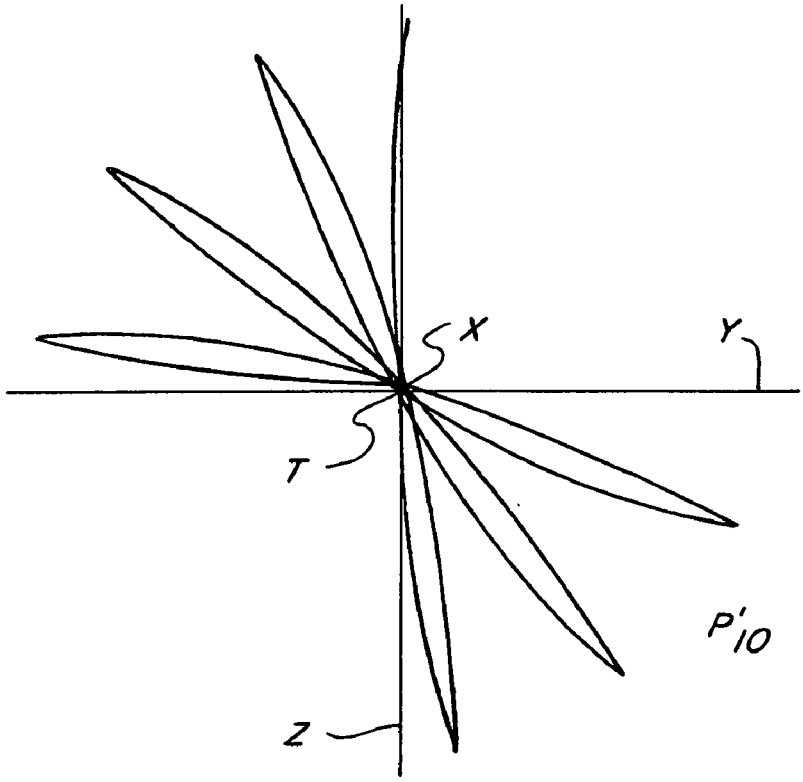
FIG. 14 is an illustration of the paths shown in FIG. 13 but viewed directly down axis X.
Figure 18:
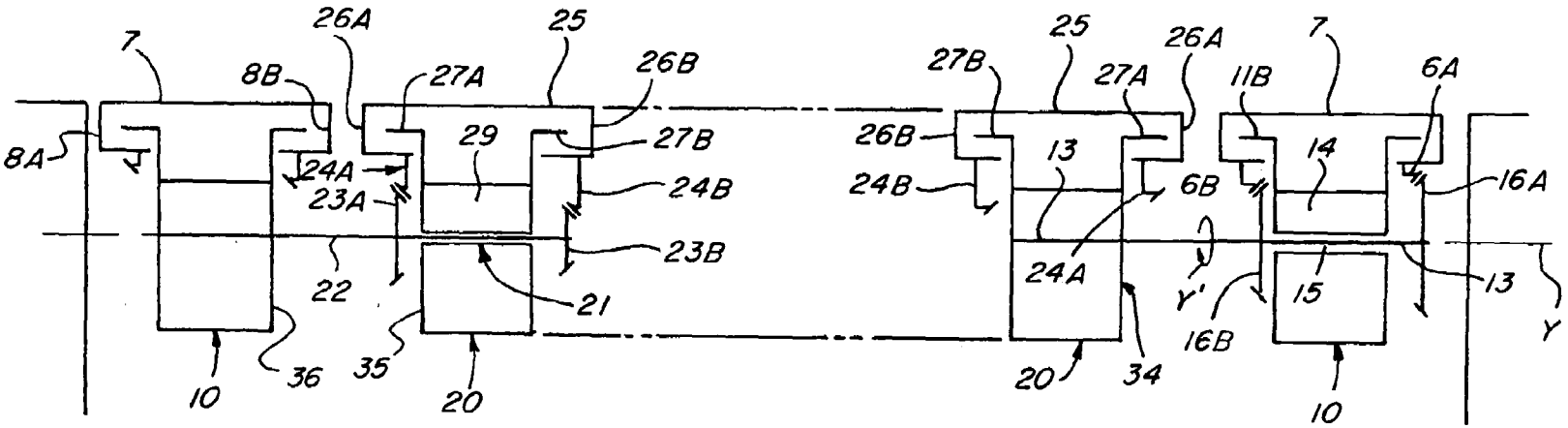
FIG. 18 is a cross-sectional skeletal view along line 18—18 of FIG. 2.
Figure 19:
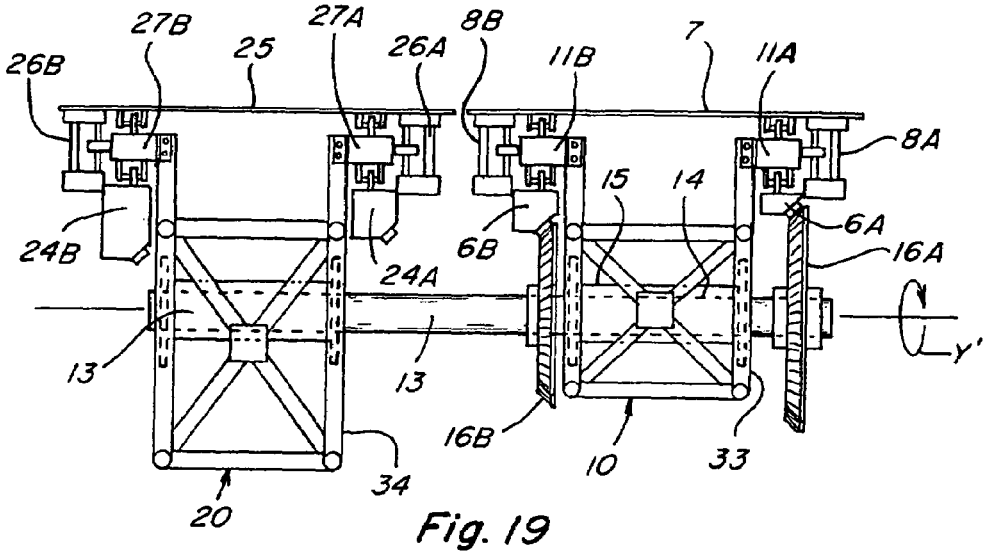
FIG. 19 is a partial cross-sectional view along line 19—19 of FIG. 2 showing the transfer gear of the present invention.
Figure 20:
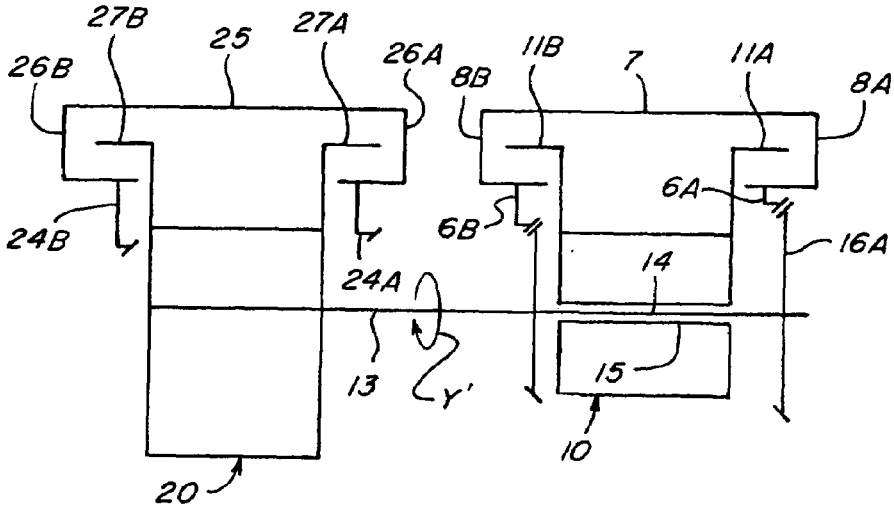
FIG. 20 is a skeletal view of FIG. 19.
Figure 21:
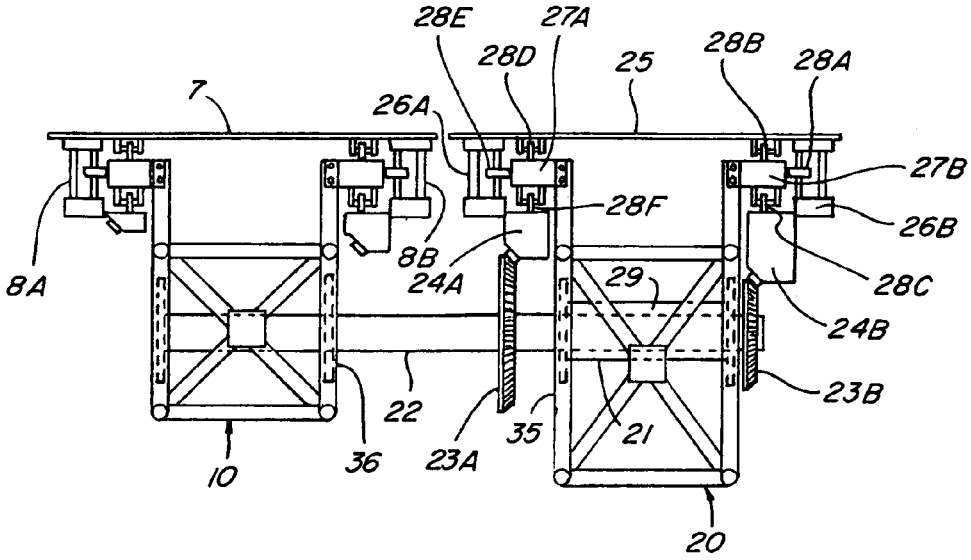
FIG. 21 is a partial cross-sectional view along line 21—21.

At FIG. 18, as inner wheel 20 revolves transversely about axis Y, inner wheel 20 at its section 35, via opening 21, also revolves around a second static shaft 22 which is securely affixed to outer wheel 10 at a second static point 36. At an end of the static shaft 22, opposite point 36 of outer wheel 10 and at static point 35 of inner wheel 20, shaft 22 extends through dual static gears 23A and 23B about which walks dual inner wheel ring gears 24A and 24B respectively during the course of inner wheel 20's transverse revolution about axis Y. As they walk, the inner ring gears 24A and 24B, which are intimately connected to carriage 25 via supports 26A and 26B, slideably engage with tracks 27A and 27B. Accordingly, as the ring gears 24A and 24B walk around static gears 23A and 23B, carriage member 25 rotates axially about axis $Z_{20}$ by way of the path $Z'_{20}$ (see FIGS. 5 and 5*a*). Inner wheel rollers 28A, 28B, 28C, 28D, 28E and 28F enable the sliding axial rotation of carriage 25. Rollers 28C and 28F are actually connected to the tracks 27B and 27A respectively and thus roll along the top surfaces of ring gears 24B and 24A respectively, while other inner ring rollers such as 28A, 28B, 28D, and 28E are integrally connected to carriage 25 via supports 26B and 26A, and roll along tracks 27B and 27A. There is also preferably a bushing 29 disposed within opening 21 for which a more effective transverse revolution of inner wheel 20 can occur about shaft 22.

Figure 16A:
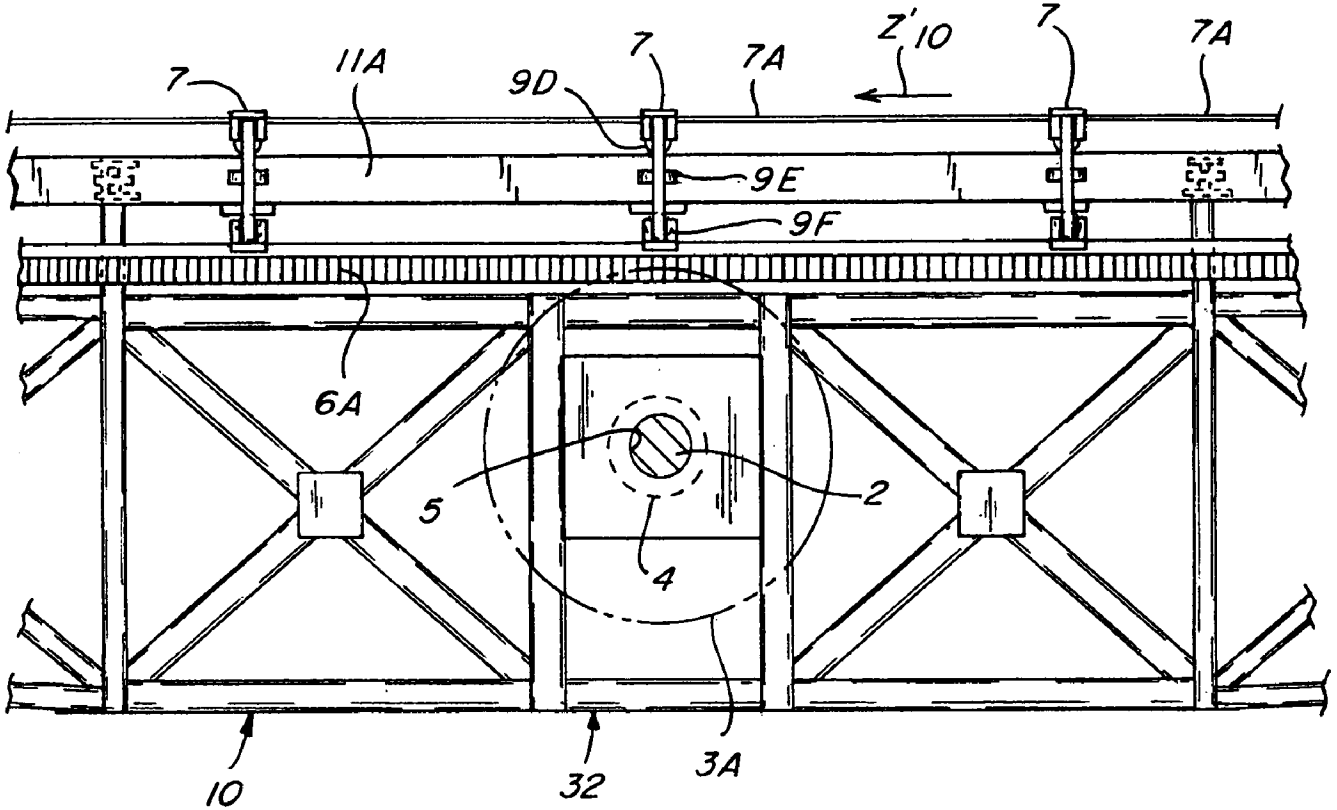
FIG. 16*a* is a partial side view of FIG. 16 viewed from behind coupling mechanism or gear 6A.
Figure 17:
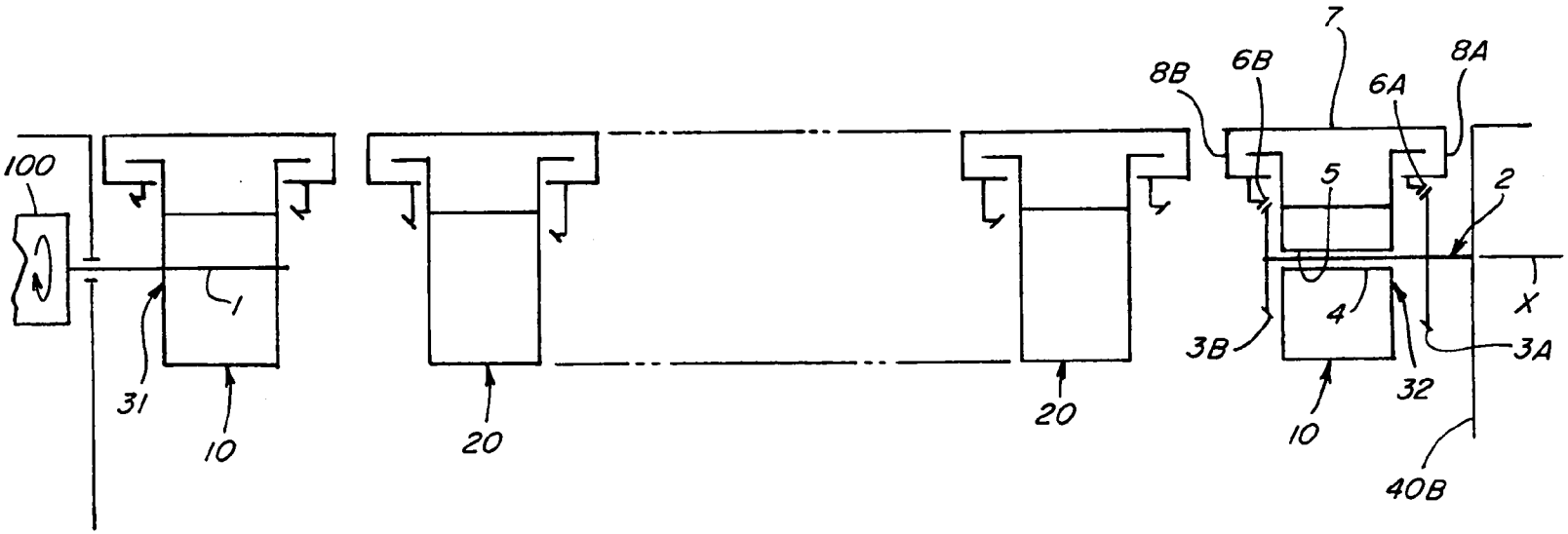
FIG. 17 is a cross-sectional skeletal view along line 17—17 in FIG. 2.

At FIGS. 16 and 16*a* additional views of the static gear position 32 may be seen. FIG. 16 illustrates an embodiment for hydraulic or pneumatic cylinder 41 which actuates ram 42 which, in turn, actuates locking number 43 into position for locking of outer wheel 10 by engaging the wheel at 32. Note carriage connector 7A shown in FIG. 16*a* may be a continuous member for connecting the lateral bars designated as carriage 7.

Figure 2:
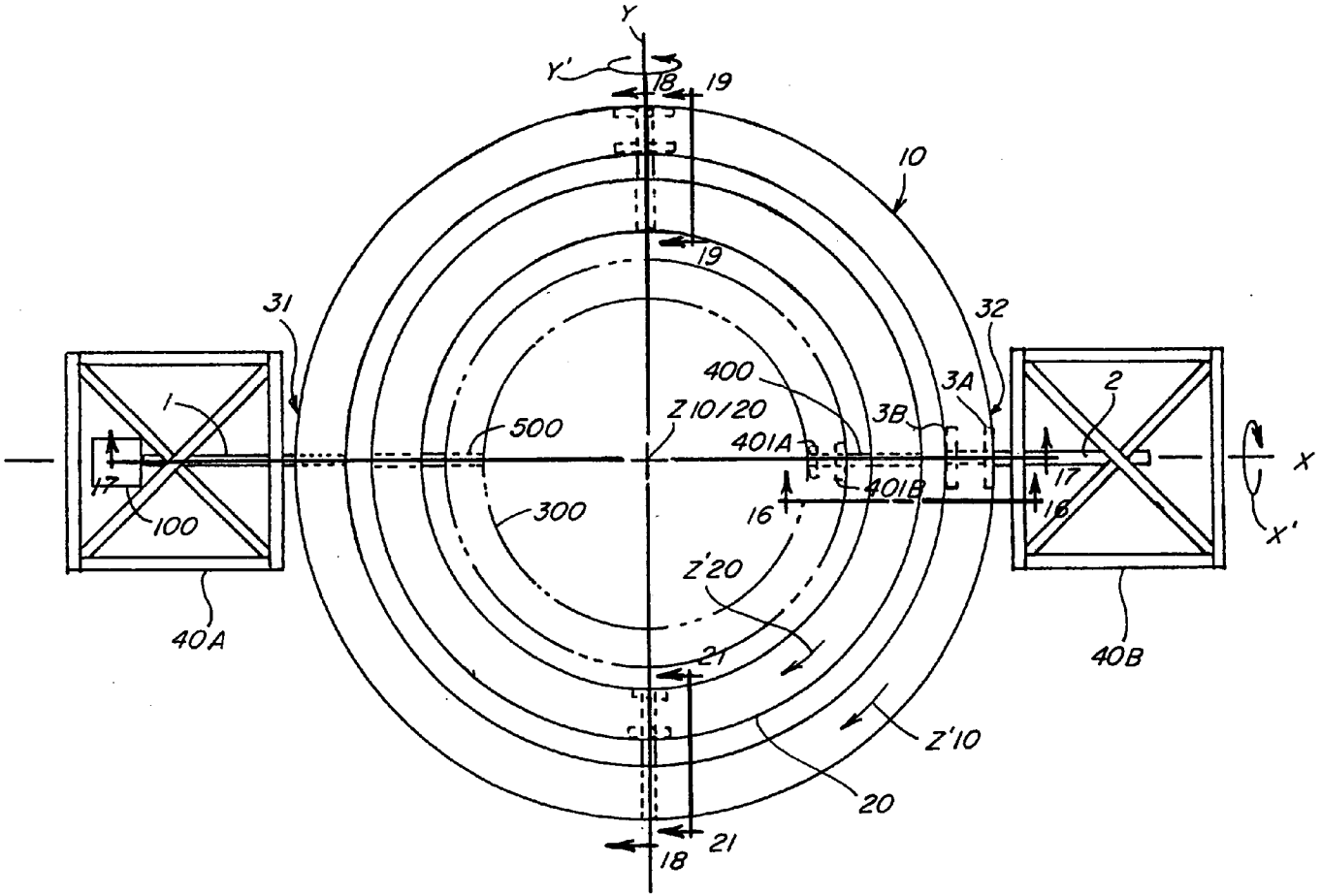
FIG. 2 is a top view of the amusement ride.
Figure 3:
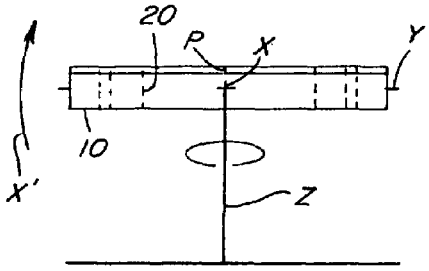
FIGS. 3–10 are sequential scenes of the movement of the outer wheels and inner wheels of the amusement ride as viewed directly down axis X, and said wheels moving at a ratio 1:1 relative to one another.
Figure 3A:
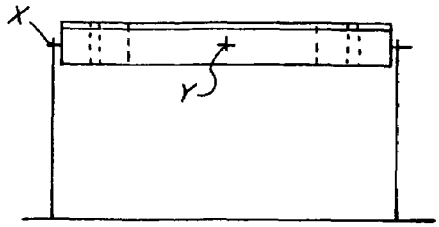
Figure 4:
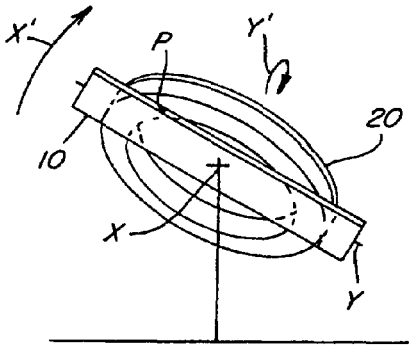
Figure 4A:
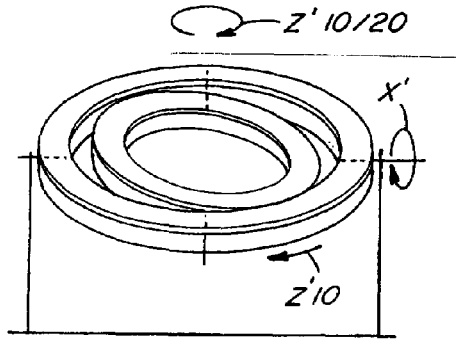

If desired, additional inner wheels, such as inner wheel 300, may be employed as depicted in FIG. 2. Such inner wheels as inner wheel 300 may be gimbaled as a mirror image of the previously described gimbals via for example transfer shaft 400 and transfer gears 401A and 401B, static shaft 500, all shown in FIG. 2.

Figure 22:
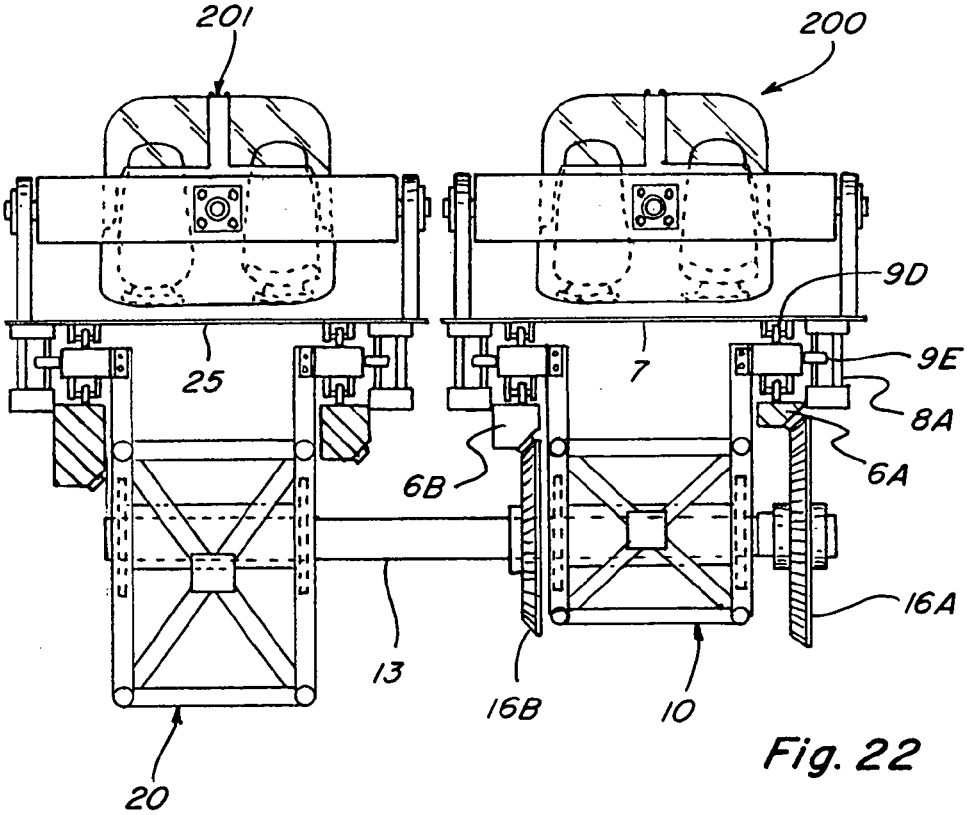
FIG. 22 is the same partial cross section as FIG. 19 but includes views of prospective passenger car embodiments.
Figure 23:
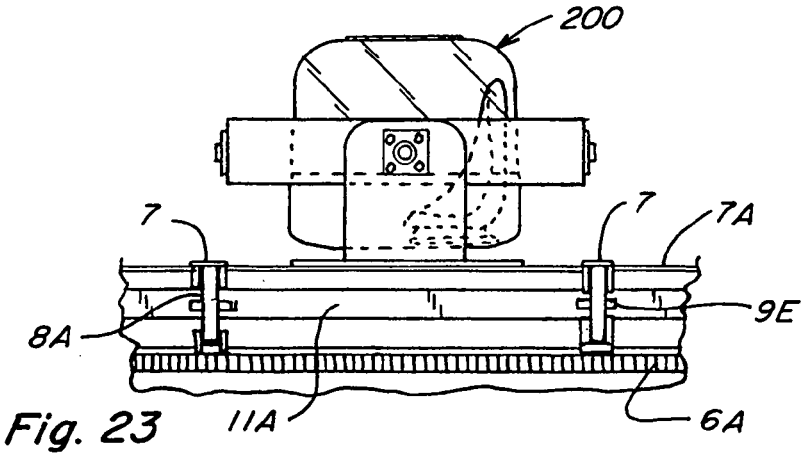
FIG. 23 is a partial right side view of car 200.

FIGS. 22 and 23 show particular embodiments of passenger cars 200 and 201 supported by or suspended from carriages 7 and 25. It should be noted that in an alternative embodiment the passenger cars can be entrained together as for example roller coaster type seating, or the cars 200 and 201 may themselves be gimbaled within a frame suspended within carriages 7 and 25.

Whereas the present invention has been described with respect to the specific embodiments illustrated, it will be understood that various changes and modifications will be suggested to one skilled in the art and it is intended to encompass such changes and modifications as fall within the scope of the invention. Not the least of those modifications are equivalent embodiments for achieving the power features of the present invention including but not limited to Servo mechanisms, hydraulic pump systems, pneumatic systems, etc. Shafts and gears may be in some cases ball bearings, rack and pinion etc. Additionally, the gear mechanism including but not limited to the static gear, the transfer gear, and the ring gears, may be assisted by chains or substitution may be achieved through belt and pulley mechanisms, hydraulic fluid components, pneumatic components, electronic components, and others all of which are within contemplation of the present invention. Furthermore it would be understood that the novel ride sensation provided by the novel amusement ride of the present invention may be simulated digitally and provided in the form of an interactive video game or other games simulating the path of travel of passengers enjoying the amusement ride of the present invention.

What is claimed is:

1. An amusement ride comprising at least two wheels gimbaled, one within the other, and each wheel having a least one different passenger car engaged to travel along that wheels' periphery, at least one of the wheel's path of travel for its cars comprises travel about at least 3 axes, and at least two of the wheel's path of travel for its respective cars comprises travel about at least 2 axes.

2. The amusement ride of claim 1 wherein the wheels are gimbaled by shaft and gear mechanisms.

3. The amusement ride of claim 2 wherein the wheels are gimbaled by gears are assisted by chains.

4. The amusement ride of claim 1 wherein the wheels gimbaled by belts and pulleys.

5. The amusement ride of claim 1 wherein either pneumatic or hydraulic or electronic mechanisms or combinations thereof are employed to either wholly or partially power the ride.

6. An amusement ride, comprising:

a. an outer wheel member, supporting at least one passenger car at its periphery, said outer wheel being revolvable transversely about a first horizontal axis with the at least one passenger car being rotatable axially along the outer wheels periphery; and, b. at least one inner wheel, gimbaled to said outer wheel so as to also to be revolvable transversely about said first horizontal axis, within said outer wheel, while also being revolvable transversely about a second horizontal axis perpendicular to said first horizontal axis, and said inner wheel also supporting at least one passenger car which is rotatable radially along said inner wheel's periphery.

7. The ride of claim 6 wherein said outer and inner wheel's transverse revolutions and their respective passenger cars' radial rotations all being driveable by a single force applied to the outer wheel.

8. The amusement ride of claim 7 where the ratio of axial rotations to transverse revolutions depends upon the gear ratio between the ring gears and the static gears.

9. The amusement ride of claim 6 further comprising:

a. the said outer and inner wheel passenger cars each respectively being suspended from outer and inner top carriages, each carriage being slideably connected to a track atop the respective wheels; and b. each of said carriages being matingly engaged to slide in an axial rotation, in tandem with a ring gear which also rotates axially and which peripherally engages a vertically disposed static gear, which engagement enables said axial rotation to occur as a response to the respective wheel's transverse revolution; and c. the transverse revolution of the outer wheel being enabled by the rotation of a drive shaft affixed horizontally to a drive section of the outer wheel; and d. a horizontal static shaft supporting said vertical static gear, said shaft being located through a section of said outer wheel positioned 180° opposite of the drive section, said static shaft allowing said outer wheel to revolve about it as a transverse axis; and e. at a transfer section on said outer wheel located 90° from the static section, there being a rotatable horizontal shaft having transfer gears affixed thereto to receive power from the rotation of the outer ring gear and to translate said power into driving power for the transverse revolution of the inner wheel;

whereby the transverse revolution of the outer wheel and the radial rotation of its passenger cars create the transverse revolution of the inner wheel and the radial rotation of its cars.

10. The amusement ride of claim 6 further comprising:

a. an inner wheel static gear affixed to a static shaft that is horizontally affixed to a section of the outer wheel; and b. located 180° opposite of said inner wheel's static shaft there being said horizontal transfer shaft and transfer gear.

11. An amusement ride comprising:

a support structure, a first closed loop track, a first coupling mechanism associating said first closed loop track with said support structure, said first coupling mechanism including a first drive mechanism operable to effect rotational movement of said first closed loop track about an axis of rotation, a second closed loop track disposed interiorly of said first closed loop track, a second coupling mechanism associating said second closed loop track with said first closed loop track, said second coupling mechanism including a second drive mechanism operable to effect rotational movement of said second closed loop track about an axis of rotation, said axis of rotation of said second closed loop being distinct from said axis of rotation of said first closed loop track, at least one passenger module coupled to said second closed loop track and movable therealong, a third drive mechanism operable to effect movement of said passenger module along said second closed loop track, whereby simultaneous operation of said first, second, and third drive means subjects said passenger module coupled to said second closed loop track to continuing movements through three degrees of motion as said passenger module traverses said second closed loop track.

* * * * *

UNITED STATES PATENT AND TRADEMARK OFFICE

CERTIFICATE OF CORRECTION

PATENT NO. : 7,172,511 B2
APPLICATION NO. : 11/028163
DATED : February 6, 2007
INVENTOR(S) : Thomas P. Casey It is certified that error appears in the above-identified patent and that said Letters Patent is hereby corrected as shown below:

Column 5, line 16, after “wheels”, delete “are”.

Column 5, line 18, after “wheels”, add -- are--.

Signed and Sealed this

Tenth Day of April, 2007

JON W. DUDAS
*Director of the United States Patent and Trademark Office*